US005699875A

United States Patent [19]

Dugan

[11] Patent Number: 5,699,875

[45] Date of Patent: Dec. 23, 1997

[54] LIFELINE ANCHOR

[75] Inventor: Joseph T. Dugan, Jackson, Wis.

[73] Assignee: Spancrete Industries, Inc., Milwaukee, Wis.

[21] Appl. No.: 550,576

[22] Filed: Oct. 31, 1995

[51] Int. Cl.[6] ..... A62B 35/00

[52] U.S. Cl. ..... 182/3; 52/27

[58] Field of Search ..... 182/3, 45; 248/507, 248/500, 925, 231.91, 231.9; 52/698, 27; 411/435

[56] References Cited

U.S. PATENT DOCUMENTS

| | | | |
|---|---|---|---|
| 1,037,142 | 8/1912 | Hazen | 52/698 X |
| 2,099,116 | 11/1937 | Kalmbach | 248/222.52 |
| 2,347,581 | 4/1944 | Turner | 52/698 X |
| 2,428,381 | 10/1947 | Parry | 411/435 |
| 3,365,093 | 1/1968 | Mallenke | 411/435 |
| 3,367,620 | 2/1968 | Holt | 249/213 |
| 3,404,503 | 10/1968 | Courtois et al. | 52/701 |
| 3,431,012 | 3/1969 | Courtois et al. | 294/86 |
| 5,011,106 | 4/1991 | Cody | 248/237 |
| 5,143,171 | 9/1992 | Glynn et al. | 182/3 |
| 5,248,021 | 9/1993 | Nichols | 182/3 |
| 5,346,036 | 9/1994 | Arisman et al. | 182/3 |
| 5,398,777 | 3/1995 | Ouellette et al. | 182/3 |

FOREIGN PATENT DOCUMENTS

| | | | |
|---|---|---|---|
| 3931494 | 4/1991 | Germany | 52/698 |
| 335054 | 9/1930 | United Kingdom | 52/27 |

*Primary Examiner*—Alvin C. Chin-Shue

*Attorney, Agent, or Firm*—Andrus, Sceales, Starke & Sawall

[57] ABSTRACT

An anchor for securing a line to a ground-based receiving member having inner walls which define an opening therein includes a rod adapted to be received in the opening formed in the receiving member. The rod has an anchoring member at a lower end and a threaded portion provided on an upper end. A collar arrangement located between the anchoring member and the threaded portion and above the receiving member is provided for rotating the rod and forming a loop to which a line may be secured. A nut-handle assembly is rotatably mounted on the threaded portion of the rod. With this arrangement, limited rotation of the collar assembly for rotating the rod causes the anchoring member to substantially register with the inner walls forming the opening in the receiving member. Subsequent rotation of the nut-handle assembly draws the anchoring member upwardly to positively lock the anchoring member in the receiving member.

4 Claims, 2 Drawing Sheets

FIG. 4
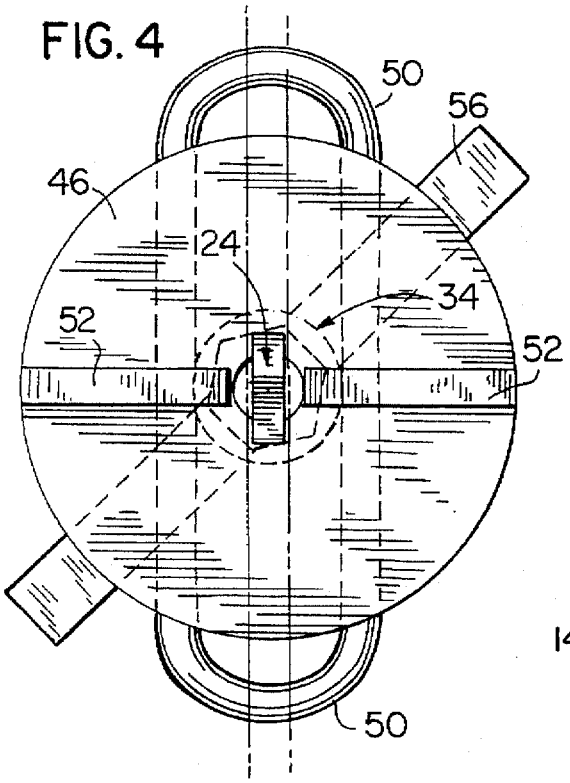
FIG. 5
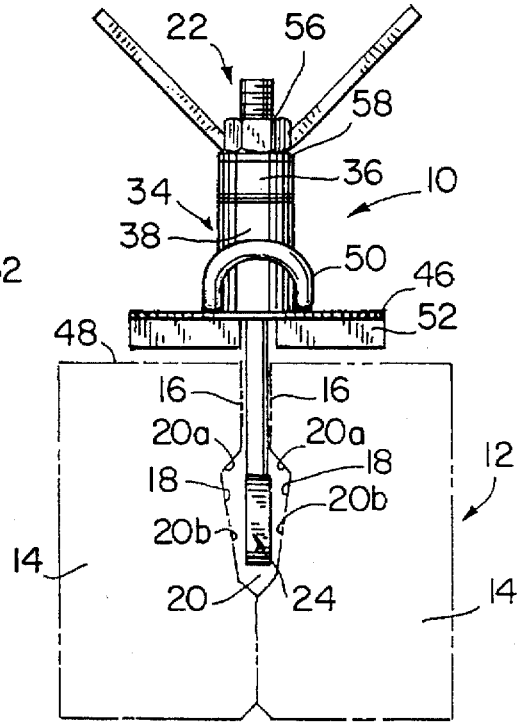
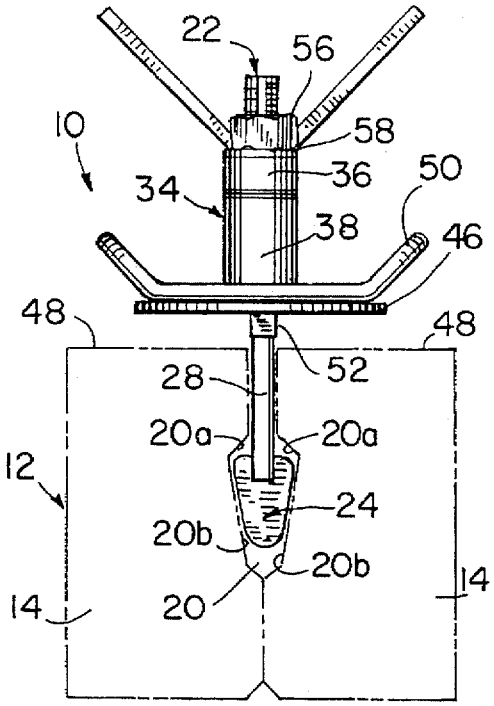
FIG.6
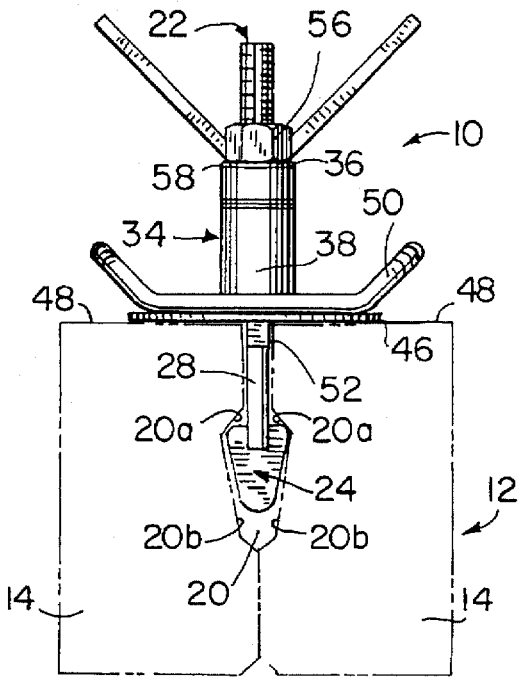
FIG. 7

LIFELINE ANCHOR

FIELD OF THE INVENTION

This invention relates broadly to safety arrangements and devices for insuring the safety of workers while stationed on a roof or an elevated structure. More particularly, the present invention is directed towards an apparatus and method whereby a secure lifeline attachment point can be provided for use in building construction, particularly when using pre-cast concrete decking panels or planks.

BACKGROUND OF THE INVENTION

In conventional safety systems to which the invention relates, lifelines are directly or indirectly securely anchored to a fixed structure and connect with a safety belt or harness worn by the worker. One of the critical problems which is encountered in connection with such safety systems is securing the safety device to the roof structure so that the safety device remains effectively anchored should it be subject to immediate, severe loading due to an accidental fall or usage in an emergency situation. Providing a suitable anchoring structure is especially problematic during construction or while the roof structure is only partially installed.

For some construction projects, it is common for pre-cast concrete decking panels or planks to be lifted and positioned on a framework to form the floors or decks for the structure. Such pre-cast panels typically have widths on the order of four feet or more and thicknesses on the order of 8 to 12 inches. Both sides of the panel are slightly tapered and are traversed by groove-like channels which function as lifting notches. The panels are typically hollow core members manufactured from reinforced concrete. The panels are grabbed at the notches by self-loading tongs or hooks for lifting the panels into position.

One example of such structure is shown in U.S. Pat. No. 5,398,777 issued Mar. 21, 1995 to Ouellette et al. In this design, the lifeline anchor assembly employs a pair of clamp bars which are adapted and positionable for engaging opposing lifting notches of the pre-cast panel. The retractable lifeline is received in mounting shoes which are mounted to the top of a frame which extends across the top of the panel. A lock, in the form of ratchet jack, locks the clamp bars into clamping engagement against the lifting notches of the concrete panel thereby providing an anchor for the retractable lifeline. Because the frame is dimensioned to mount over and span the panel sides, different sized frames must be used with different sized panels causing an unnecessary increase in maintenance expenses.

Other prior art devices which involve drilling into or embedding elements in the concrete, or employing spring loaded members have also been less than desirable because of their complicated structure or installation procedures.

It has long been recognized that fall protection of workers is a particular problem during the installation of pre-cast concrete deck panels because of the difficulty in providing an effective anchoring location for a lifeline. During conventional pre-cast panel construction techniques, it remains highly desirable and necessary that the workers essentially be stationed near the leading edge of the deck as the panels are transferred into position so that the next panel in sequence may be properly positioned.

SUMMARY OF THE INVENTION

The present invention advantageously provides an anchor for a safety lifeline which allows a construction worker to be tethered to the anchor safely, which meets some of the more stringent government regulations, which can be installed conveniently and quickly in pre-cast concrete assemblies without special tools or procedures, and which is sufficiently affordable so as to be cost effective for any size pre-cast concrete deck or panel.

In one aspect of the invention, an anchor for securing a line to a ground-based receiving member having inner walls which define an opening therein comprises a rod adapted to be received in the opening formed in the receiving member. The rod has an anchoring member located on a lower end thereof and a threaded portion provided on an upper end. A rotatable arrangement located between the anchoring member and the threaded portion and above the receiving member is provided for rotating the rod and providing a loop to which a line may be secured. A nut-handle assembly is rotatably mounted on the threaded portion of the rod. Limited rotation of the rotatable arrangement for rotating the rod causes the anchoring member to substantially register with the inner walls forming the opening in the receiving member and subsequent rotation of the nut-handle assembly draws the anchoring member upwardly to positively lock the anchoring member in the receiving member.

In another aspect of the invention, a method is contemplated for securing a line to a ground-based receiving member having inner walls which define an opening therein. The method comprises the steps of:

a) providing a coil rod adapted to be received in the opening formed in the receiving member, the coil rod having an anchoring member located on a lower end thereof and a threaded portion provided on an upper end;

b) providing an arrangement between the anchoring member and the threaded portion and above the receiving member for rotating the coil rod and providing a loop to which a line may be secured; and c) rotatably mounting a nut-handle assembly on the threaded portion of the coil rod.

Limited rotation of the arrangement for rotating the coil rod causes the anchoring member to substantially register with the inner walls which define an opening in the receiving member and subsequent rotation of the nut-handle assembly draws the coil rod and the anchoring member upwardly to positively lock the anchoring member in the receiving member.

In yet another aspect of the invention, a lifeline anchor for securing a safety lifeline to a pre-cast concrete assembly having a gap formed by the inner walls between abutting concrete panel comprises a vertically oriented coil rod adapted to be received in the gap formed between the inner walls of the abutting concrete panels. The coil rod has an anchoring member located on a lower end and a threaded portion provided on an upper end. The threaded portion is also formed with a longitudinally extending key way. A collar assembly disposed around the coil rod includes a key engageable with the key way such that rotation of the collar assembly will cause simultaneous rotation of the coil rod. The collar assembly has a flat surface at a lower end constructed and arranged to overlie an upper surface of the abutting concrete panels. The flat surface also has a central bore through which the coil rod extends and an anchor loop to which a lifeline may be attached. The flat surface further includes a pair of parallel, downwardly depending guide bars adapted to sit in the gap. A nut-handle assembly is rotatably mounted on the threaded portion of the coil rod. With the guide bars disposed above the upper surface of the abutting panels and the anchoring member disposed in the gap, rotation of the collar assembly when keyed to the coil rod will cause the periphery of the anchoring member to lie within the inner walls forming the gap between said abutting concrete panels and permit said guide bars to sit in the gap to prevent further rotation of the collar assembly and the coil rod. Subsequent rotation of the nut-handle assembly against the collar assembly draws the coil rod and the anchoring member upwardly to positively lock the wedging member in the pre-cast concrete assembly.

BRIEF DESCRIPTION OF THE DRAWINGS

The invention will become better understood by reference to the following description of the preferred exemplary embodiment when read in conjunction with the appended drawing wherein like numerals denote like elements.

FIG. 4 is a sectional view taken on line 4—4 of FIG. 3; and

FIGS. 5–7 are sequential views showing the installation of the lifeline anchor in connection with a pre-cast concrete assembly.

DETAILED DESCRIPTION OF THE PREFERRED EMBODIMENT

Figure 1:
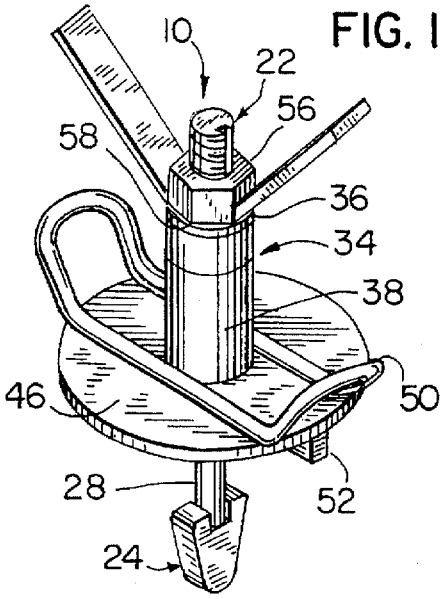
FIG. 1 is a perspective view of a lifeline anchor embodying the present invention.

With reference to the drawings, a lifeline anchor in accordance with the present invention is generally designated by the numeral 10. The lifeline anchor 10 is preferably adapted for anchoring to a receiving member such as a pre-cast concrete assembly 12 formed by substantially identical pre-cast concrete panels 14 which are sequentially lifted and positioned in side-by-side abutting relationship. The panels 14 are typically hollow core members manufactured from reinforced concrete and generally measure 8 to 12 inches in thickness and several feet in width and length. The lifeline anchor 10 is adapted to receive a retractable lifeline system (not shown) to provide fall protection for a construction worker installing such pre-cast concrete panels 14 to form a roof or deck. Upon installation, the pre-cast concrete panels 14 abut along inner side walls 16 so that concavities 18 formed on each panel 14 will form an arrow-shaped opening or gap 20 which has outwardly flaring surfaces **20*a* and downwardly diverging surfaces 20*b*. The gap 20** is eventually filled with grout or a similar material.

Figure 2:
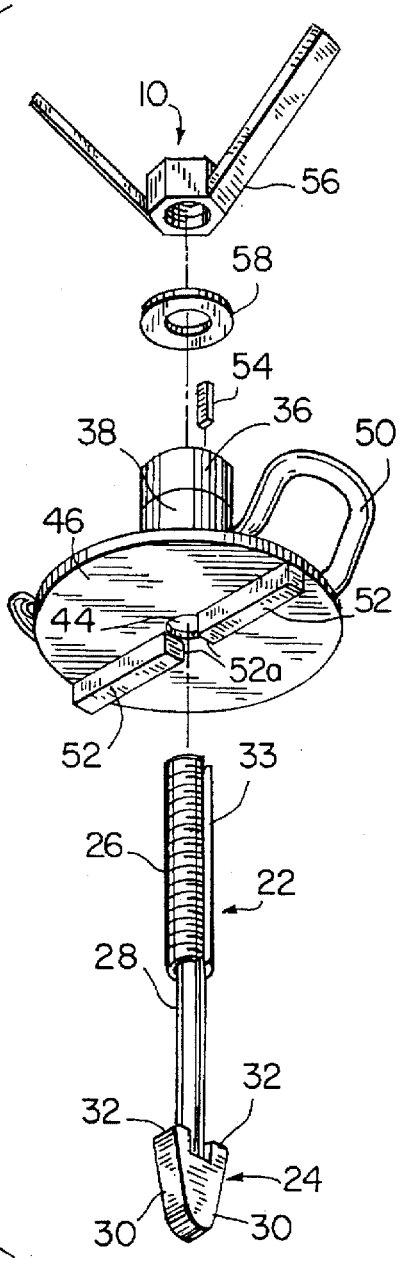
FIG. 2 is an exploded view of the lifeline anchor of FIG. 1.
Figure 3:
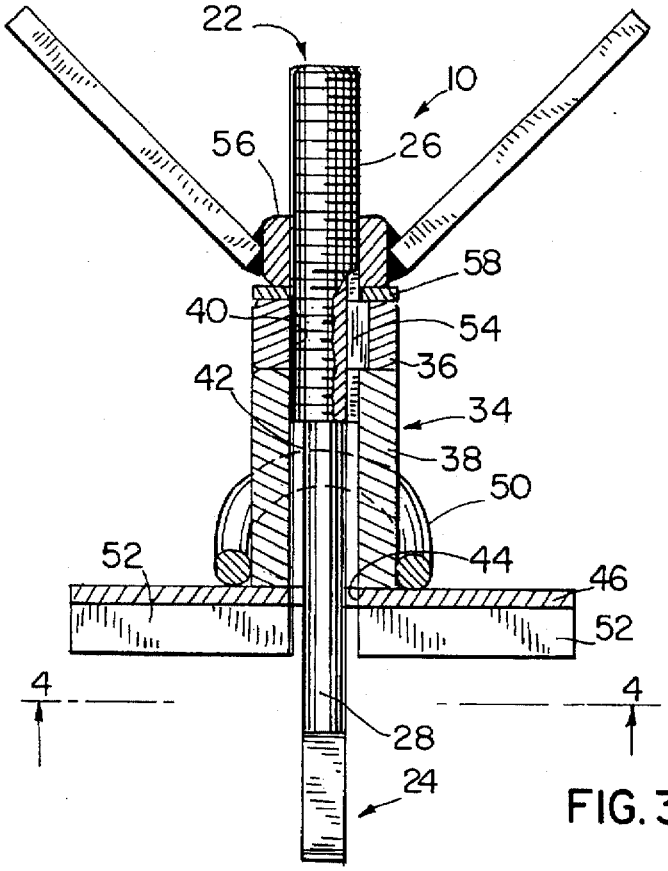
FIG. 3 is a sectional view of the lifeline anchor of FIG. 1.

According to the invention, anchor 10 includes a substantially vertically oriented coil rod 22 adapted to be inserted and received in the gap 20. The coil rod 22 has an anchoring member 24 on its lower end, a coarsely threaded portion 26 on its upper end, and a generally smooth, cylindrical portion 28 therebetween. The anchoring member 24 includes upwardly diverging lateral surfaces 30 merging into upwardly facing shoulders 32 and resembles an arrowhead in configuration. Anchoring member 24 has a width and is oriented as shown in FIG. 5, so that it will pass freely into the gap 20. As best seen in FIG. 2, the threaded portion 26 of coil rod 22 is provided along its entire length with a key way 33 extending parallel to the longitudinal axis of the coil rod 22.

A collar assembly 34 is disposed around the coil rod 22 and includes a generally cylindrical collar 36 welded or otherwise secured to a substantially cylindrical spacer 38. The collar 36 and spacer 38 have aligned throughbores 40, 42 which are in turn aligned with a central bore 44 of a flat disk 46 fixed at a lower end of the collar assembly 34 and designed to overlie an upper surface 48 of the abutting concrete panels 14. The flat disk 46 includes an anchor loop 50 to which a lifeline may be attached and a pair of straight, spaced apart, downwardly depending aligned guide bars 52 with parallel, opposed, facing ends adapted to sit in the upper portion of the gap 20 as will be hereafter described. Each guide bar 52 extends radially from central bore 44 to the periphery of flat disk 46. The aligned guide bars 52 have a longitudinal axis which is substantially perpendicular to a longitudinal axis of the coil rod 22. The collar 36 carries a key 54 which is engageable with the key way 33 formed in threaded portion 26 of the coil rod 22 such that rotation of the collar assembly 34 will cause simultaneous rotation of the coil rod 22. A nut-handle assembly 56 is rotatably mounted on the threaded portion 26 of the coil rod 22 against a washer 58 located between the collar 36 and the nut-handle assembly 56.

The anchor 10 may be easily installed in an efficient manner. After two panels of a pre-cast concrete assembly 12 are installed forming the gap 20 therebetween, anchoring member 24 is lowered into the gap 20 and the guide bars 52 are disposed above or on the upper surface 48 of the abutting concrete panels 14. Lowering of the anchor 10 is accomplished by the operator who utilizes the nut-handle assembly 56 or loop 50 to align the coil rod 22 with the gap 20, the anchoring member 24 being oriented as shown in FIG. 5 so that it will pass freely between the walls **20*a*, 20*b* of the gap 20. Thereafter, as illustrated in FIG. 6, limited rotation of the collar assembly 34 through 90° when keyed to the coil rod 22 will cause anchoring member 24 to substantially register with or lie within the inner walls 16 forming the gap 20 at which point, shown in FIG. 7, the guide bars 52 will drop down and sit in the upper portion of the gap 20 to prevent further rotation of the collar assembly 34 and the coil rod 22. Subsequent rotation of the nut-handle assembly 56 against the washer 58 and the collar assembly 34 then draws the coil rod 22 upwardly so that the upwardly facing shoulders 32 of the anchoring member 24 push against the outwardly flaring surfaces 20*a* forming the inner walls 16 of the gap 20 to positively lock the anchoring member 24 with the pre-cast concrete assembly 12**.

As installation proceeds and there is no further need for the anchor 10 in its original location, release of the interlocking connection between the pre-cast concrete assembly 12 and the anchor 10 is affected by backing off of the nut-handle assembly 56 to such an extent that the coil rod 22 will be slightly lowered in the gap 20. The collar assembly 34 is then raised and rotated 90° to place the guide bars 52 above the upper surface 48 of the pre-cast concrete assembly 12 and release the anchoring member 24 from its fit in gap 20 so it is free to pass upwardly out of the gap 20. Removal of the anchor 10 exposes the gap 20 which may be filled with grout or otherwise suitably plugged. The anchor 10 is then available for use as desired with a different pair of abutting concrete panels 14.

It should be appreciated that the anchor 10 embodying the present invention is easily yet securely installed without any drilling and without the use of special tools or procedures. Unlike other prior art anchors, the present design avoids complicated arrangements involving spring loaded members and inserts embedded in poured concrete. The present invention provides a new and improved anchor and method of installing same which continually implements a secure and temporary anchorage with a pre-cast deck under construction without interfering with the structure or construction sequence.

While the invention has been described with reference to a preferred embodiment, those skilled in the art will appreciate that certain substitutions, alterations and omissions may be made without departing from the spirit thereof. For example, while the anchor 10 has been described in the preferred environment of a pre-cast concrete assembly, it should be understood that the anchor 10 is temporarily engageable with the inner walls of a receiving member such as the inner diameter of a vertical pipe, and in such instance may be used to anchor warning lines or the like. Accordingly, the foregoing description is meant to be exemplary only, and should not be deemed limitative on the scope of the invention set forth with following claims.

I claim:

1. A lifeline anchor for securing a safety lifeline to a pre-cast concrete assembly having a gap formed by inner walls between abutting concrete panels comprising:

a vertically oriented coil rod adapted to be received in said gap formed between the inner walls of said abutting concrete panels, said coil rod having an anchoring member located on a lower end and a threaded portion provided on an upper end, said threaded portion being formed with a longitudinally extending key way;

a collar assembly disposed around said coil rod said collar assembly having a flat disk at a lower end constructed and arranged to overlie an upper surface of the abutting concrete panels, said flat disk having a central bore through which said coil rod extends and an anchor loop to which a lifeline may be attached, said flat disk further including a pair of spaced apart, downwardly depending, aligned guide bars adapted to sit in said gap, said guide bars having opposed, parallel facing ends spaced apart by said central bore, each of said guide bars extending radially from said central bore to a periphery of said flat disk, said collar assembly further includes a cylindrical spacer disposed on top of said flat disk and over said central bore, and a cylindrical collar secured on top of said cylindrical spacer, said collar including a key engageable with said key way such that rotation of said collar assembly will cause simultaneous rotation of said coil rod; and a nut-handle assembly rotatably mounted on said threaded portion of said coil rod: said nut handle assembly having a pair of upwardly and outwardly diverging handles;

whereby with said guide bars disposed above said upper surface of the abutting panels and said anchoring member disposed in said gap, rotation of said collar assembly when keyed to said coil rod will cause the periphery of said anchoring member to lie within the inner walls forming said gap between said abutting concrete panels and permit said guide bars to drop down and sit in said gap to prevent further rotation of said collar assembly and said coil rod, and whereby subsequent rotation of said nut-handle assembly against said collar assembly draws said coil rod and said anchoring member upwardly to positively lock said anchoring member in the pre-cast concrete assembly.

2. The lifeline anchor of claim 6, wherein said anchoring member includes upwardly diverging lateral surfaces merging into upwardly facing shoulders.

3. The lifeline anchor of claim 1, wherein said coil rod includes a smooth, cylindrical portion extending between said anchoring member and said threaded portion.

4. The lifeline anchor of claim 1, wherein said anchoring member is shaped in the form of an arrowhead.

* * * * *

UNITED STATES PATENT AND TRADEMARK OFFICE

CERTIFICATE OF CORRECTION

PATENT NO. : 5,699,875

DATED : December 23, 1997

INVENTOR(S) : JOSEPH T. DUGAN

It is certified that error appears in the above-indentified patent and that said Letters Patent is hereby corrected as shown below:

In The Claims

Claim 1, column 5, line 24, After "coil rod" insert ---,--- (comma); Claim 1, column 6, line 8, After "coil rod" delete ";" (semicolon) and insert ---,--- (comma); Claim 2, column 6, line 25, Cancel "6": and insert ---1---

Signed and Sealed this

Fourteenth Day of April, 1998

Bruce Lehman

*Attest:*

BRUCE LEHMAN

*Attesting Officer*

*Commissioner of Patents and Trademarks*